US012000103B2

(12) United States Patent
O'Sullivan

(10) Patent No.: US 12,000,103 B2
(45) Date of Patent: Jun. 4, 2024

(54) MODULAR PANEL BASEMENT SHORING APPARATUS

(71) Applicant: Kenneth O'Sullivan, Sydney (AU)

(72) Inventor: Kenneth O'Sullivan, Sydney (AU)

( * ) Notice: Subject to any disclaimer, the term of this patent is extended or adjusted under 35 U.S.C. 154(b) by 194 days.

(21) Appl. No.: 17/642,402

(22) PCT Filed: Mar. 10, 2020

(86) PCT No.: PCT/AU2020/050224
§ 371 (c)(1),
(2) Date: Mar. 11, 2022

(87) PCT Pub. No.: WO2021/046589
PCT Pub. Date: Mar. 18, 2021

(65) Prior Publication Data

US 2022/0333330 A1 Oct. 20, 2022

(30) Foreign Application Priority Data

Sep. 12, 2019 (AU) ..... 2019903397

(51) Int. Cl.
*E02D 11/00* (2006.01)
*E02D 5/03* (2006.01)
(Continued)

(52) U.S. Cl.
CPC ..... *E02D 11/00* (2013.01); *E02D 5/03* (2013.01); *E02D 5/56* (2013.01); *E02D 7/22* (2013.01);
(Continued)

(58) Field of Classification Search
CPC .... E02D 5/02; E02D 5/03; E02D 5/04; E02D 5/06; E02D 5/08; E02D 5/24; E02D 5/56; E02D 7/22; E02D 17/04
See application file for complete search history.

(56) References Cited

U.S. PATENT DOCUMENTS 3,999,392 A * 12/1976 Fukushima ..... E02D 5/20 405/281
4,585,678 A * 4/1986 Kunito ..... E02D 5/04 428/33
(Continued)

FOREIGN PATENT DOCUMENTS

JP 2003-293361 A 10/2003
JP 3178869 U 10/2012
(Continued)

OTHER PUBLICATIONS

International Search Report for application No. PCT/AU2020/050224, dated Apr. 20, 2020.

*Primary Examiner* — Frederick L Lagman
(74) *Attorney, Agent, or Firm* — INNOVATION CAPITAL LAW GROUP, LLP; Vic Lin

(57) ABSTRACT

Basement shoring apparatus has a modular panel having a panel body having a plurality of parallel drill rod shafts therethrough. Each drill rod shaft has a respective drill rod rotatably engaged therein. Each drill rod extends from a lower edge of the panel body and has a respective auger or cutting head attached at a distal end thereof. Each drill rod is connectable via an upper edge of the panel body for turning. Adjacent drill rods extend to different extent such that blades of respective augers overlap adjacently. As such, modular panel can be drilled into the ground to form shoring wall.

22 Claims, 7 Drawing Sheets

(51) Int. Cl.

| | |
|---|---|
| ***E02D 5/56*** | (2006.01) |
| ***E02D 7/22*** | (2006.01) |
| ***E02D 17/04*** | (2006.01) |
| *E21B 10/44* | (2006.01) |

(52) U.S. Cl.
CPC ..... *E02D 17/04* (2013.01); *E02D 2250/0038* (2013.01); *E21B 10/44* (2013.01)

(56) References Cited

U.S. PATENT DOCUMENTS

| | | | | |
|---|---|---|---|---|
| 4,906,142 | A | 3/1990 | Taki et al. | |
| 2005/0254905 | A1 * | 11/2005 | Nishiyama | E02D 5/06 405/274 |

FOREIGN PATENT DOCUMENTS

| | | | | |
|---|---|---|---|---|
| KR | 100781810 | B1 | * | 12/2007 |
| KR | 101808960 | B1 | * | 12/2017 |
| KR | 101851114 | B1 | * | 5/2018 |
| WO | WO 1993/025766 | A1 | | 12/1993 |

* cited by examiner

MODULAR PANEL BASEMENT SHORING APPARATUS

FIELD OF THE INVENTION

This invention relates generally to a modular panel system for basement shoring. It should be noted that whereas the embodiments have been described herein with reference to basement shoring, the invention may be applicable for other types of walled constructions.

SUMMARY OF THE DISCLOSURE

The present invention comprises modular panels which can be drilled into the ground to form shoring wall. Lowermost panels comprise augers for self-drilling and vertically adjacent panels can connect to drill rods thereof to continuously drill to desirous depth. Cutting heads may be utilised as opposed to augers, depending on ground conditions.

Each panel body may be of uniform construction for both vertically and horizontally adjacent modularity.

The drill augurs which may be longitudinally offset to adjacently overlap such that a cutting formation thereof exceeds the longitudinal cross-section of the panel, thereby allowing the panel to follow within the excavation formed by the augers.

The panels may be horizontally connected at edges thereof and vertically connected by connecting together drill rods thereof, thereby forming a wall section in a modular manner.

Once vertically connected panels are drilled to requisite depth, the panels may be flushed with air or water and filled with grout and/or a concrete mix. The concrete mix may envelop and set the augers. The drill rods may be stressed by a hydraulic stressing jack and retained by a precast ground beam.

Excavation may then commence wherein horizontal anchors and/or waler beams are added at appropriate elevations for temporary or permanent support.

The present system provides an alternative to current standard piling and shotcreting systems in allowing for continuous excavation to total basement depth, thereby eliminating staged excavation and need for steel fixing and shotcreting and therefore being more cost effective in reducing labour and speeding construction.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 3:
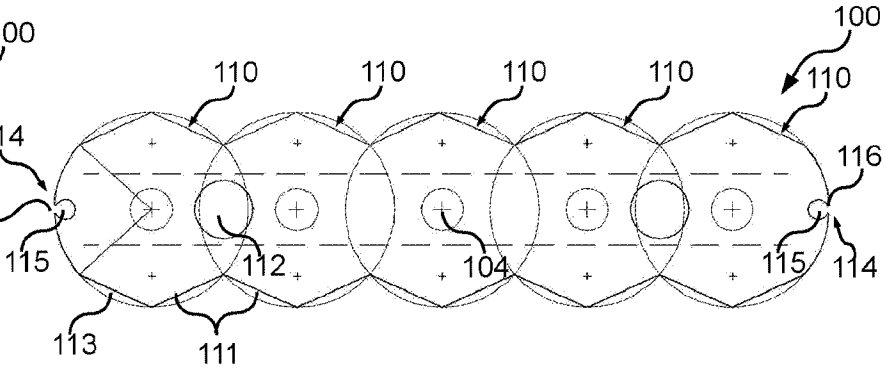
FIG. 3 shows a top plan view of the shoring panel of FIG. 1.

A modular self-drilling panel 100 may have a panel body 135 of precast reinforced concrete. The panel body 135 may comprise an upper edge 101, a lower edge 102, side edges 103, and faces 107. The panel body 135 may be generally elongate and uniform in longitudinal cross-section.

Figure 2:
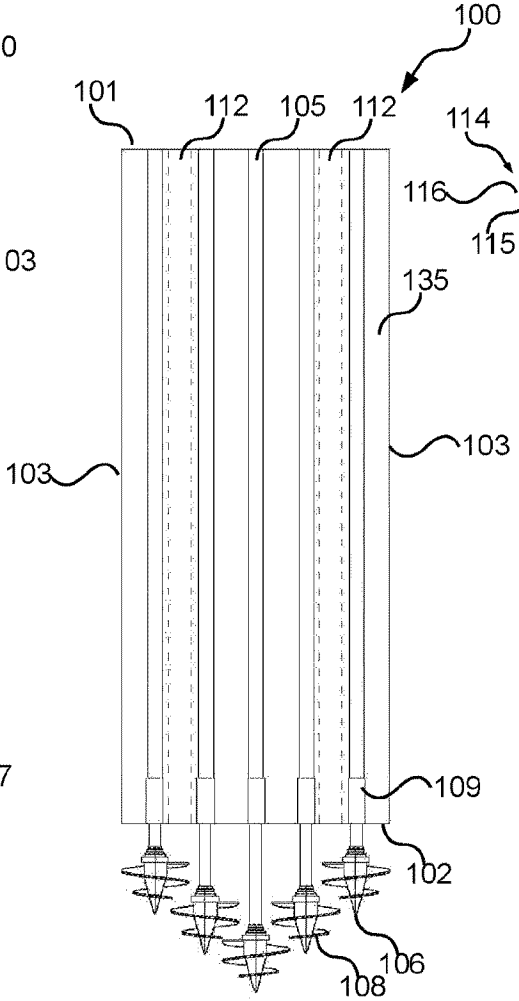
FIG. 2 shows a front elevation view of the shoring panel of FIG. 1.
Figure 1:
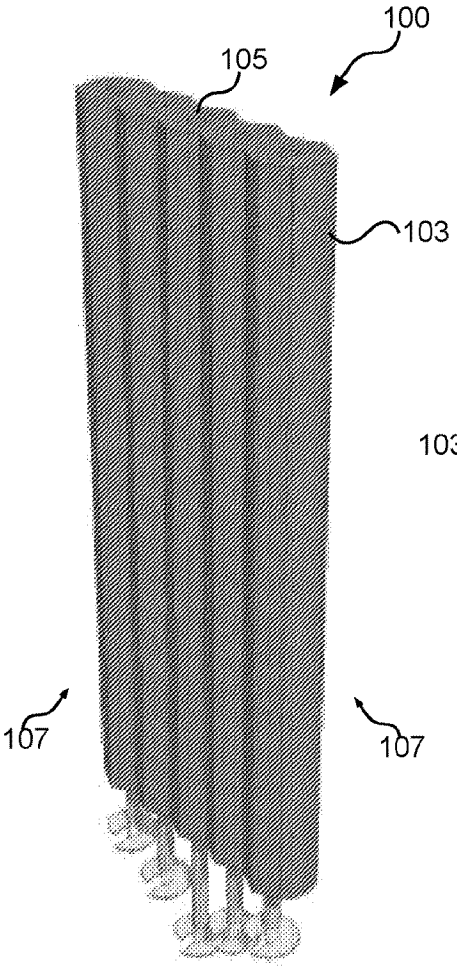
FIG. 1 shows a top perspective view of a modular self-drilling shoring panel in accordance with an embodiment.

The panel body 135 comprises a plurality of drill rod shafts 104 therethrough, each having a respective drill rod 105 rotatably engaged therein. As shown in FIG. 2, each drill rod 105 extends from the lower edge 102 of the panel body 135 and each has a self-drill auger 106 connected at a distal end thereof. In alternative embodiments, cutting heads may be utilised as opposed to augers, depending on ground conditions.

Adjacent rods 105 may extend to different extents from the lower edge 102 of the panel body 135 such that blades 108 of adjacent augers 106 overlap adjacently in the manner shown in FIG. 2.

In the embodiment shown in FIG. 2, the panel 100 comprises an odd number of drill rods 105 and augers 106, thereby having a central auger 106 and successively adjacent pairs of augers 106. In this regard, the central rod 105 may extend furthest from the bottom edge 102 of the panel body 135 such that the central auger 106 extends furthest. The central auger 106 may extend beyond the next adjacent pair of augers 106 which, in turn, extend beyond the yet next further adjacent pair of augers 106.

The drill rod 105 may be journalled within a retention collar 109 for longitudinal retention with respect to the panel body 135.

With reference to FIG. 3, the panel body 135 may comprise a plurality of segments 110. The panel body 135 may comprise greater thickness at each segment 110. Each segment 110 may be defined by planar faces 111.

Each drill rod shaft 105 may be located coaxially with respect to each segment 110.

The panel body 135 may further comprise at least one flushing conduit 112. Each flushing conduit 112 may locate between adjacent drill rod shafts 104. Each flushing conduit 112 may locate at intersections between each segment 110. In the embodiment shown in Each flushing conduit 112 may be lined, such as with PVC. In the embodiment wherein the panel body 100 comprises five drill rod shafts 104, the panel body 135 may comprise a pair of flushing conduits 112 between outermost adjacent drill rod shafts 104. However, other numbers of flushing conduits 112 are envisaged. In one embodiment, the panel 100 comprises four flushing conduits, range between adjacent of the five drill rod shafts 104.

FIG. 3 shows the maximum cutting formation cross-section 113 formed by the blades 108 of the augers 106. As alluded to above, the augers 106 may overlap adjacently, thereby forming the continuous cutting formation cross-section 113.

As is further illustrated in FIG. 3, the panel body 135 may comprise a longitudinal cross-section and the cutting diameter formation cross-section 113 may be greater than the cutting diameter formation cross-section 113 such that the panel body 135 can follow longitudinally entirely within the excavation formed by the overlapping augers 106.

Figure 4:
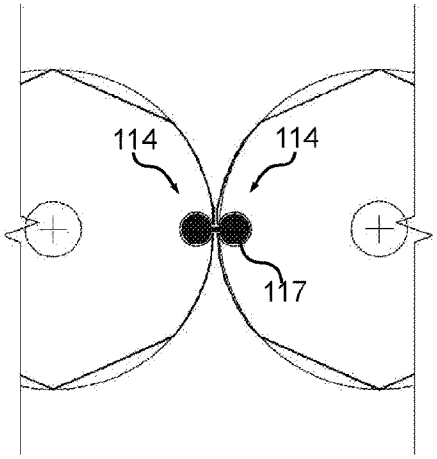
FIG. 4 illustrates interconnecting of adjacent modular panels.

With reference to FIGS. 3 and 4, the side edges 102 of the panel body 110 may comprise mating connections 114 for connecting panels 110 adjacently at respective side edges 103 thereof. Each connection 114 may comprise a bore 115 narrowing to a longitudinal entrance 116.

With reference to FIG. 4, a longitudinal connector joint 117 having a substantial figure-of-eight or hourglass cross-section may slide longitudinally between adjacent bores 115 and extend between the adjacent entrances 116 in a substantially watertight manner.

Figure 5:
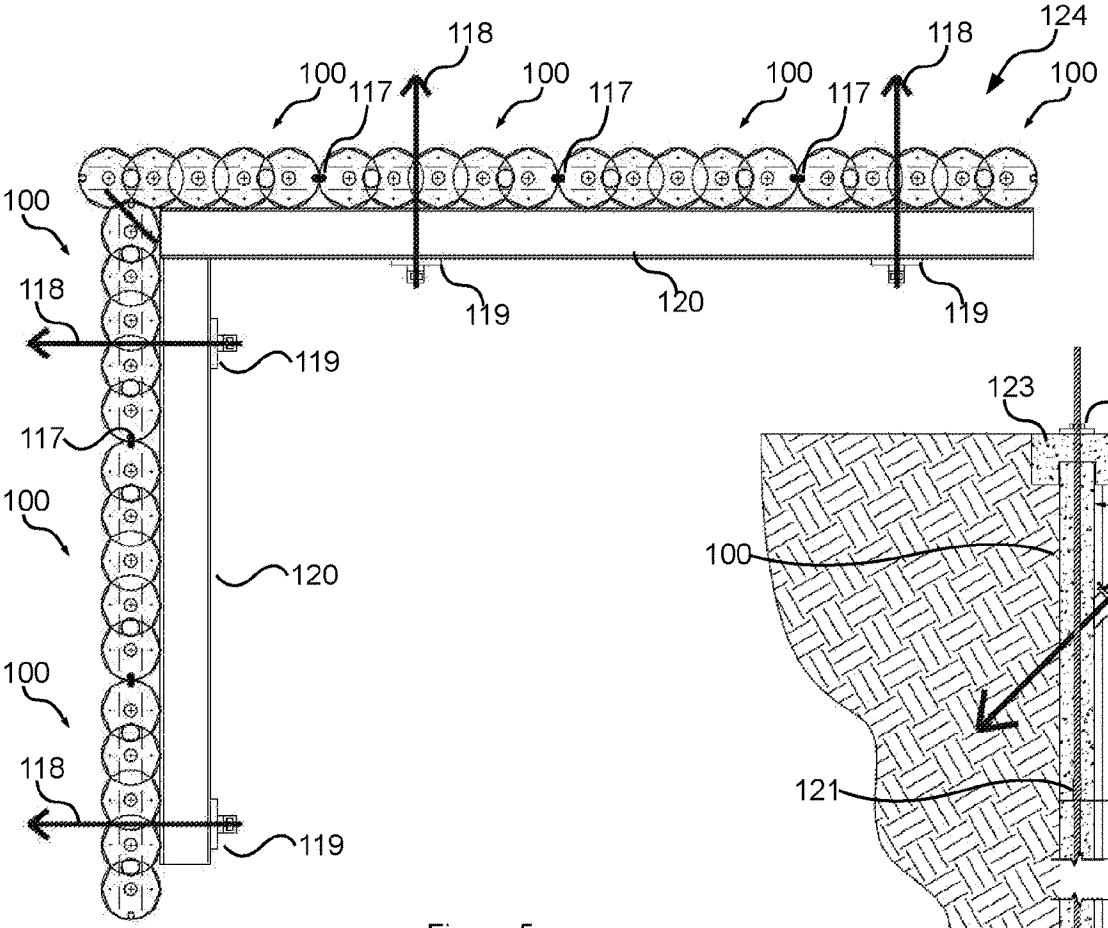
FIG. 5 shows a top plan view of a basement shoring system comprising a series of horizontally adjacently interconnected panels.

FIG. 5 shows a top plan view of a basement shoring system 124 comprising a series of horizontally adjacently interconnected panels 110. Specifically, FIG. 5 shows a 3×4 orthogonal arrangement of panels 110 connected adjacently by connected joints 117.

Anchors 118 may extend through the panels 110 for anchoring in adjacent subterrain. Proximal ends of each anchor 118 may engage respective attachments 119 supported transversely by bracing 120.

Figure 6:
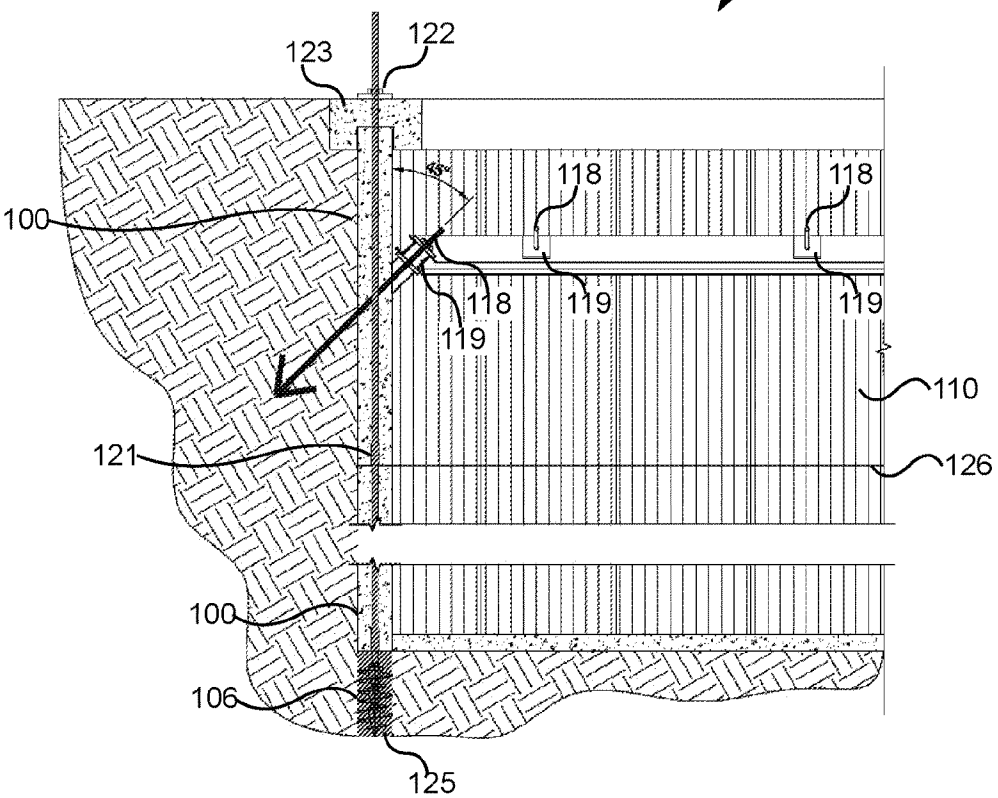
FIG. 6 shows a side elevation view of the basement shoring system.

FIG. 6 shows a side elevation view of the basement shoring system 124 illustrating the stacking of vertically adjacent interconnected panels 100 across one or more vertical edge interfaces 126.

Specifically, FIG. 6 shows the panels 100 comprising a lowermost panel 100 comprising the augers 106 extending thereunderneath. Concrete grout mixture 125 may permanently retain the augers 106 thereof. Drill rods 105 of successively vertically adjacent panels 100 may be connected together at a drill rod connection 121 substantially at each vertical edge interface 106.

An upper most drill rod 105 may be retained by a precast ground beam 123 and stressed by a plate and nut 122.

FIG. 7-13 illustrate the installation of the basement shoring system 124 according to an embodiment.

Figure 7:
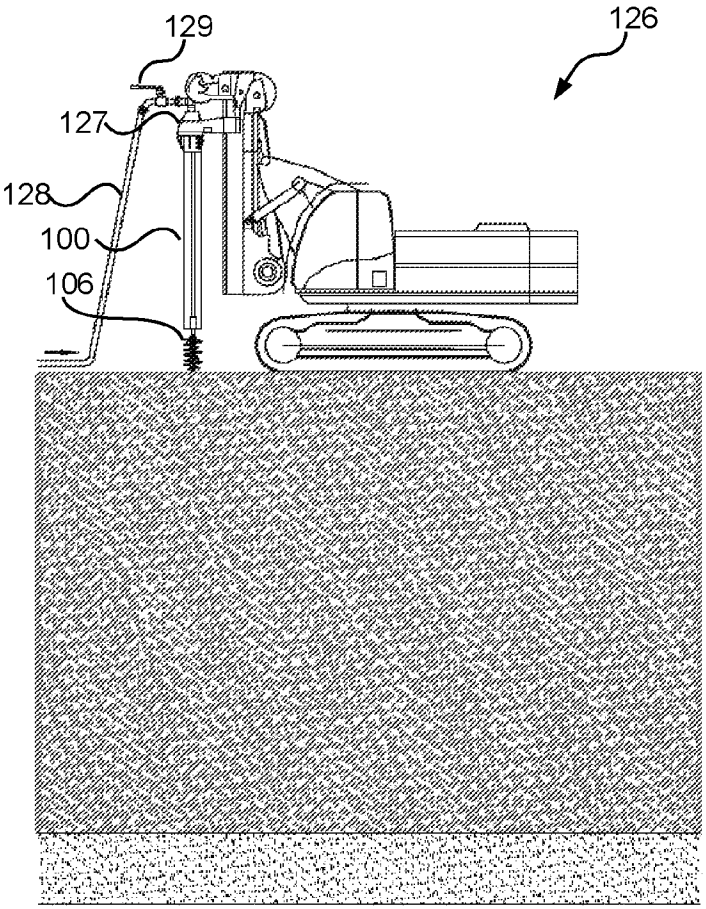

FIG. 7 illustrates a first panel 100 attached to a drilling rig 126 from a drill head 127 at an upper edge thereof. The drill head 127 comprises a drive motor or at least gearing to drive each drive rod 105 to turn each auger 106.

A supply hose 128 may be connected to the drill head 127 to force water, drilling fluid or compressed air through the flushing conduits 112 either continuously during drilling or post drilling or both. An isolation valve 129 may interface the drill head 127 and the supply hose 128. In embodiments, fluid or air may be additionally or alternatively forced between the drill rod shaft 104 and the drill rods 105.

Figure 8:
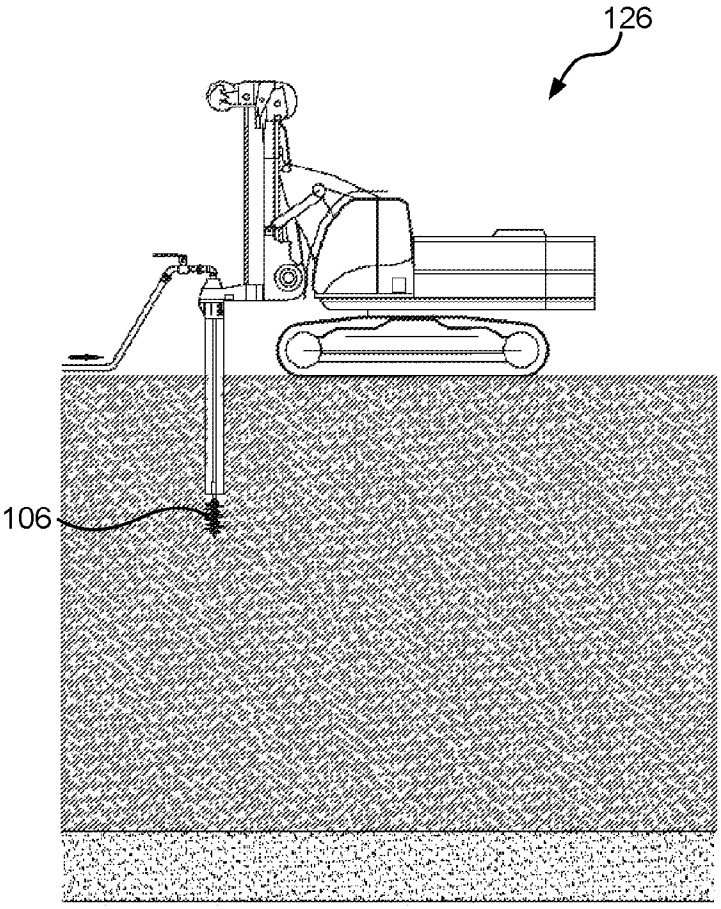
FIG. 7-13 illustrate exemplary construction of a basement shoring system using the modular panels.

According to FIG. 8, the drilling rig 126 drives the augers 106 to drill the panel 100 into the ground whilst simultaneously pressing down thereon.

The drill rig 126 may be moved adjacently to place further horizontally adjacent panels 106 in line and which may be connected together using the longitudinal connection joints 117.

Figure 9:
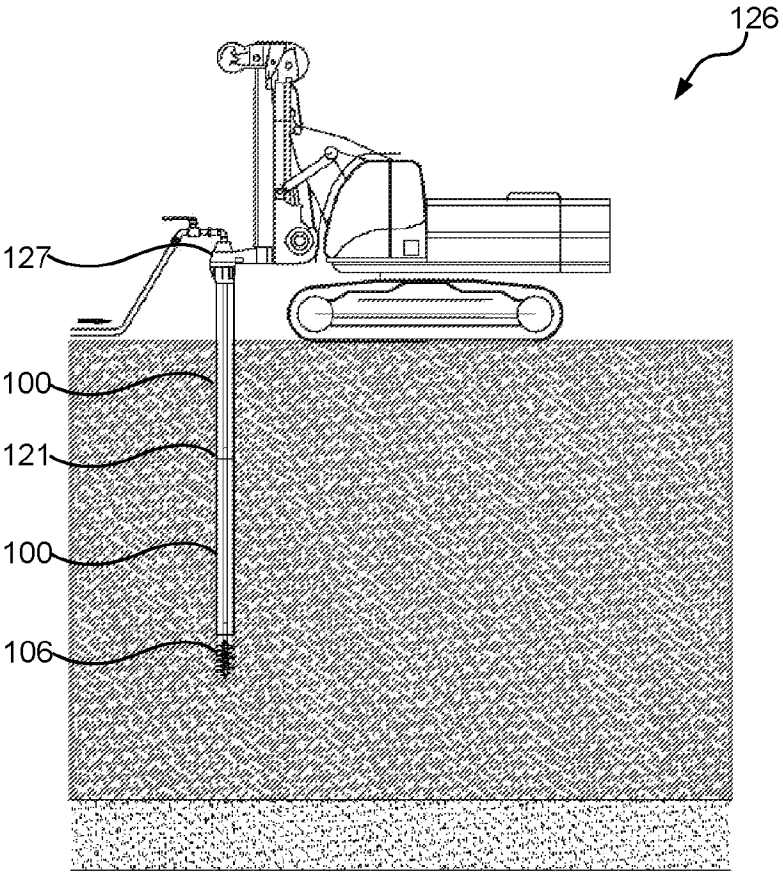

According to FIG. 9, the drill head 127 is disconnected from the lowermost panel 100 and a next panel 100 lifted by the drill rig 126 atop the lowermost panel 100.

The next panel 100 comprises drill rod connectors in lieu of augers 106 for connecting to the drill rods 106 of the lowermost panel 100 at the drill rod connection 121.

The drill rod connectors may comprise screw-type connectors wherein upper drill rods 105 turn into or over lower drill rods 105 in the same direction of rotation as the augers 106.

Figure 10:
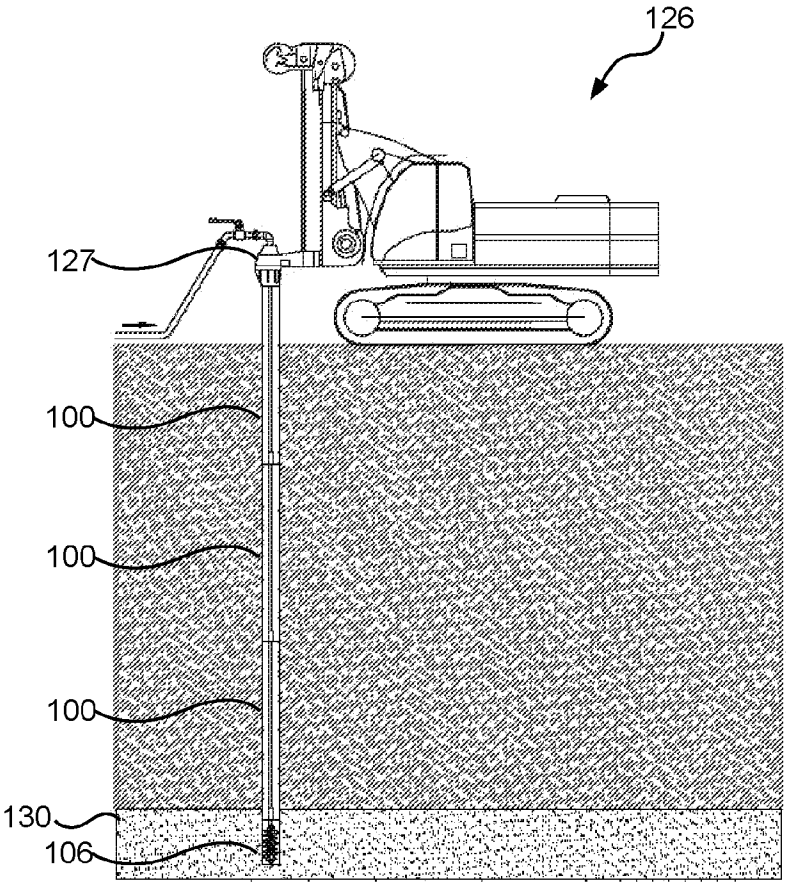

According to FIG. 10, the process may repeat with a number of vertically stacked panels 110 until the augers 106 of the lowermost panel 100 reach bedrock 103 or at least reach sufficient depth.

Figure 11:
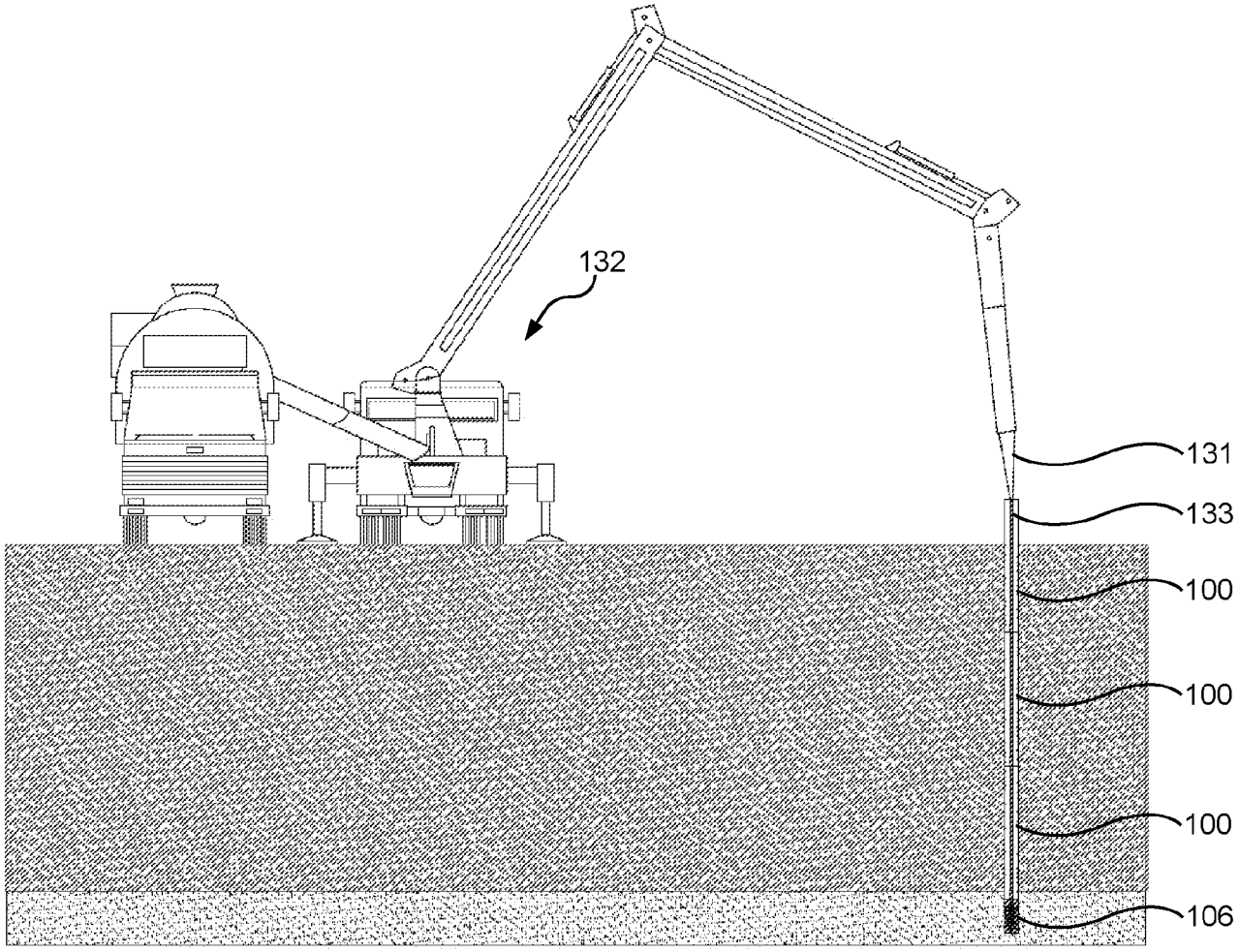

According to FIG. 11, concrete or grout mixture 133 may be pumped via a nozzle 131 of a pumping rig 132 through the flushing conduits 112 and/or drill rod shafts 104.

Preferably concrete or grout mixture is pumped to envelop the augers 106, thereby setting the augers 106 permanently in place.

Figure 12:
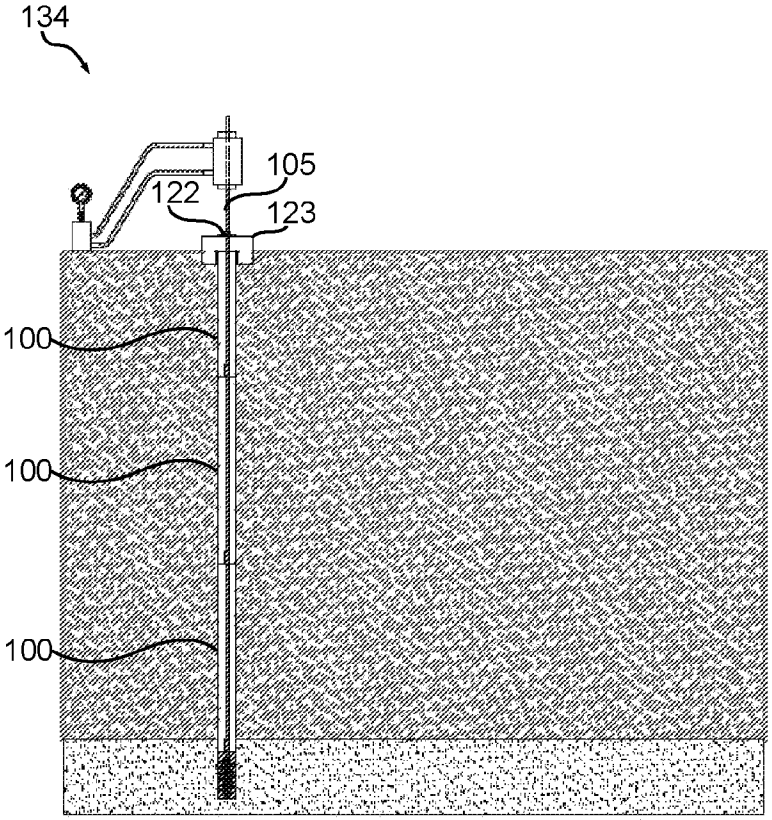
Figure 15:
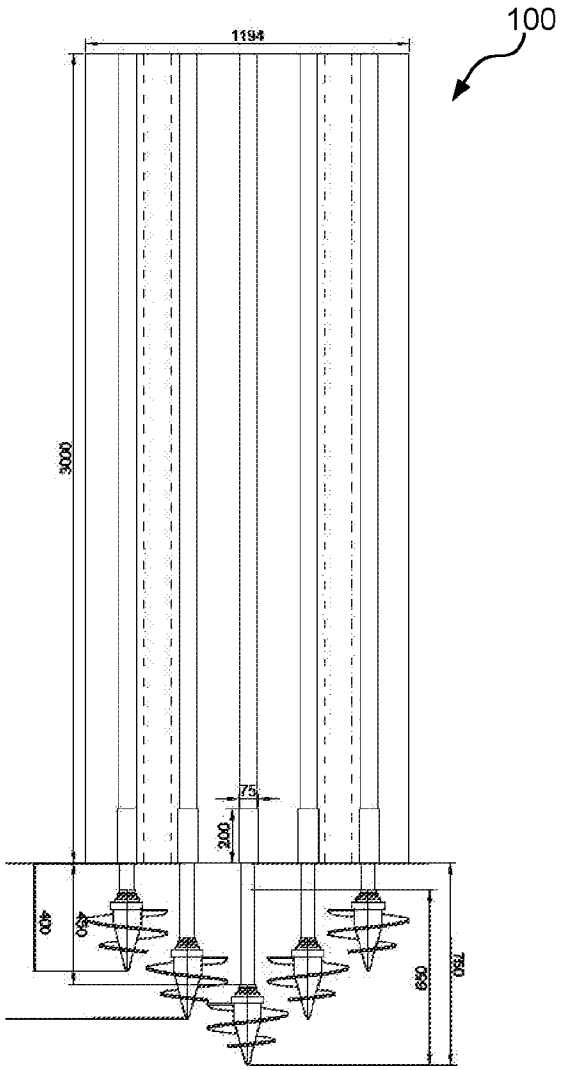
FIG. 15 shows a front elevation view of the shoring panel with exemplary dimensions.
Figure 14:
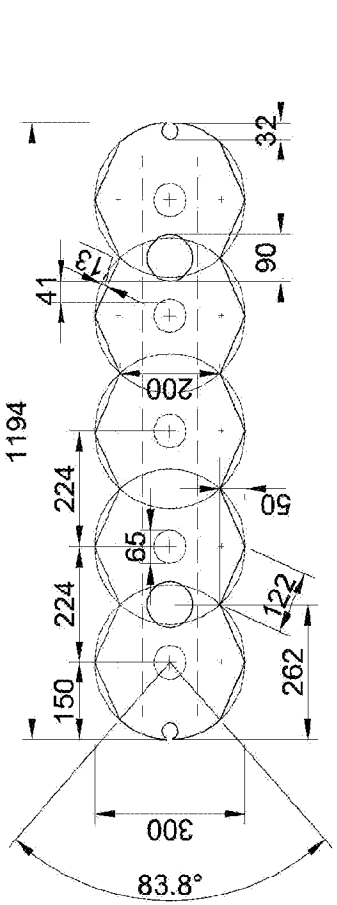
FIG. 14 shows a top plan view of the modular panel with exemplary dimension.

According to FIG. 12, the panels 100 may be stressed to required loads using a hydraulic stressing jack 134 engaging the connected series of drill rods 105 and retained by the horizontal ground beam 123 and nut and plate 122.

Figure 13:
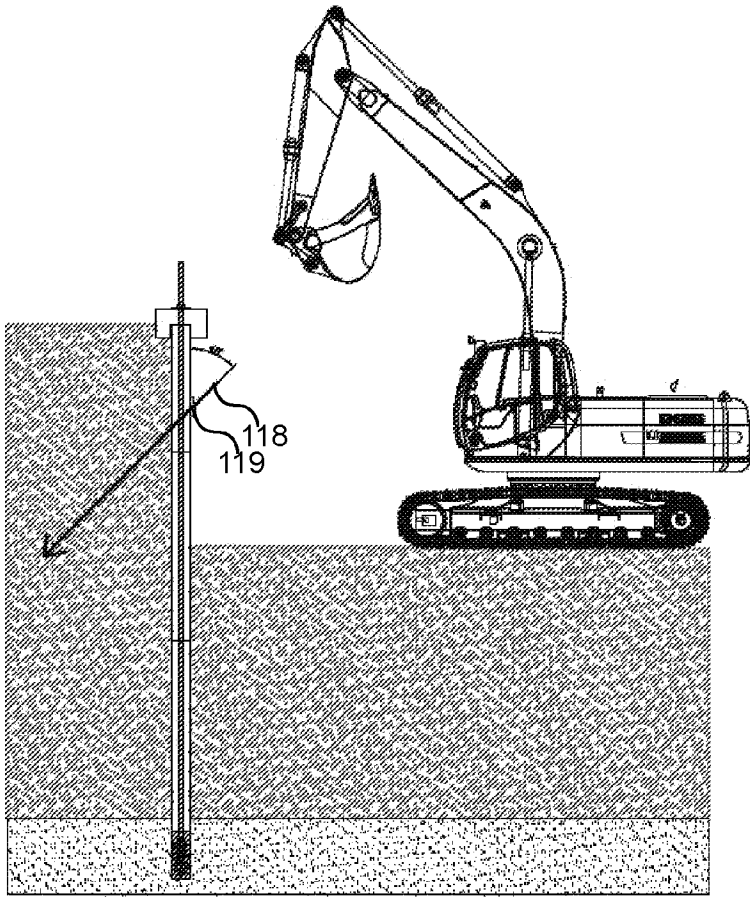

Excavation may then commence according to FIG. 13 and the anchors 118 installed at appropriate innovations and spacings.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The term "approximately" or similar as used herein should be construed as being within 10% of the value stated unless otherwise indicated.

The invention claimed is:

1. Basement shoring apparatus comprising a modular panel having a panel body comprising a plurality of parallel drill rod shafts therethrough, each having a respective drill rod rotatably engaged therein, each drill rods extending from a lower edge of the panel body and having a respective auger or cutting head attached at a distal end thereof, each drill rod connectable via an upper edge of the panel body for turning and wherein adjacent drill rods extend to different extent such that blades of respective augers or cutting heads overlap adjacently.

2. Apparatus as claimed in claim 1, wherein the panel body comprises a longitudinal cross-section and wherein the augers overlap adjacently to form a continuous cutting formation cross-section encompassing the longitudinal cross-section.

3. Apparatus as claimed in claim 1, wherein the panel body has uniform longitudinal cross-section.

4. Apparatus as claimed in claim 1, wherein the panel comprises at least one flushing conduit between at least two adjacent drill rod shafts.

5. Apparatus as claimed in claim 4, wherein the at least one flushing conduit comprises lining.

6. Apparatus as claimed in claim 5, wherein the lining comprises PVC.

7. Apparatus as claimed in claim 1, wherein the panel comprises a plurality of longitudinal segments and wherein each drill rod shaft is coaxial with each longitudinal segment.

8. Apparatus as claimed in claim 1, wherein side edges of the panel body comprise connections for mating with respective connections of horizontally adjacent panels.

9. Apparatus as claimed in claim 8, wherein the mating connection comprises a longitudinal channel narrowing to a longitudinal entrance.

10. Apparatus as claimed in claim 1, wherein the panel body comprises precast concrete.

11. Apparatus as claimed in claim 1, wherein each drill rod shaft is journalled within a retention collar for longitudinal retention.

12. Apparatus as claimed in claim 1, wherein the panel comprises an odd number of drill rods, thereby having a central drill rod having a central auger or cutting head and successively adjacent pairs of drill rods and augers.

13. Apparatus as claimed in claim 1, wherein the central auger extends further beyond successfully adjacent augers.

14. Apparatus as claimed in claim 1, wherein each drill rod is connectable with vertically adjacent drill rods of a vertically adjacent panel in use by way of a screw-type connector and wherein the screw-type connector is orientated in the same direction as rotation as it respective auger.

15. A method of basement shoring comprising connecting drill rods of a panel as claimed in claim 1 to a drill head of a drill rig, the drill head driving each drill rod, pressing and drilling the modular panel into ground;

disconnecting the panel;

connecting drill rods of a vertically adjacent modular panel to the drill rods of the panel; and driving the drill rods of the vertically adjacent modular panel using the drill head to simultaneously drill the panel and the vertically adjacent panel into the ground.

16. A method as claimed in claim 15, further comprising connecting a supply hose to force fluid or air through flushing conduits of the panel.

17. A method as claimed in claim 15, wherein the method comprises drilling until at least one of the augers engage bedrock or reach a required depth.

18. A method as claimed in claim 15, further comprising pumping cementitious material through the panels.

19. A method as claimed in claim 18, wherein pumping the cementitious material comprises pumping the cementitious material through at least one of drill rod shafts and flushing conduits of the panels.

20. A method as claimed in claim 19, further comprising pumping the cementitious material to envelop the augers.

21. A method as claimed in claim 15, wherein the method further comprises pressing and drilling a horizontally adjacent panel into the ground and connecting edges of the panel and the horizontally adjacent panel.

22. A method as claimed in claim 15, further comprising excavating adjacent the modular panel and the vertically adjacent modular panel and driving anchors through at least one of the panels into surrounding subterrain.

* * * * *